US008677672B2

(12) United States Patent
Kennedy et al.

(10) Patent No.: US 8,677,672 B2
(45) Date of Patent: Mar. 25, 2014

(54) BULLET TRAP

(75) Inventors: Bruce Kennedy, Bowenfels (AU); David John Maloney, Kelso (AU); Trevor John Pearce, Lithgow (AU)

(73) Assignee: Thales Australia Limited (AU)

( * ) Notice: Subject to any disclaimer, the term of this patent is extended or adjusted under 35 U.S.C. 154(b) by 0 days.

(21) Appl. No.: 12/596,597

(22) PCT Filed: Apr. 3, 2008

(86) PCT No.: PCT/AU2008/000476
§ 371 (c)(1),
(2), (4) Date: Nov. 24, 2010

(87) PCT Pub. No.: WO2008/128276
PCT Pub. Date: Oct. 30, 2008

(65) Prior Publication Data

US 2011/0056364 A1 Mar. 10, 2011

Related U.S. Application Data

(60) Provisional application No. 60/944,136, filed on Jun. 15, 2007.

(30) Foreign Application Priority Data

Apr. 19, 2007 (AU) ..... 2007902058

(51) Int. Cl.
*F41A 35/04* (2006.01)

(52) U.S. Cl.
USPC ..... 42/96; 89/14.5

(58) Field of Classification Search
USPC ..... 42/105, 96; 102/485; 89/36.01, 14.05; 273/410
See application file for complete search history.

(56) References Cited

U.S. PATENT DOCUMENTS

| | | | | |
|---|---|---|---|---|
| 2,853,008 | A | 9/1958 | Bowles | |
| 3,664,263 | A * | 5/1972 | Driscoll | 102/485 |
| 3,726,036 | A * | 4/1973 | Jennings et al. | 42/105 |
| 4,777,753 | A * | 10/1988 | Stancato | 42/70.11 |

(Continued)

FOREIGN PATENT DOCUMENTS

| | | |
|---|---|---|
| DE | 103 05 644 B3 | 5/2004 |
| GB | 2 031 562 A | 4/1980 |
| WO | WO 96/10159 | 4/1996 |

OTHER PUBLICATIONS

Extended European Search Report for corresponding European Patent Application No. 08733310.0-1260 (mailed Feb. 5, 2013).

*Primary Examiner* — Daniel J Troy
(74) *Attorney, Agent, or Firm* — Merchant & Gould P.C.

(57) ABSTRACT

A bullet trap (1) is provided that connects to a muzzle end (5) of a weapon (3). The bullet trap (1) has a body (11) with a chamber (17) into which a bullet can be fired. The chamber (17) has a plurality of baffles (27) located one behind the other in an aligned series arrangement. The baffles (27) absorb kinetic energy of a fired bullet and enable the bullet to be trapped within the body (11). The baffles (27) have a thickness at a center of axis of travel of a bullet less than the thickness at a radially outwardly distant position to provide for a deformation at the center of a first of a series of baffles (27) before there will be engagement of a center of second and subsequent baffles (27).

13 Claims, 2 Drawing Sheets

(56) References Cited

U.S. PATENT DOCUMENTS

| | | | | |
|---|---|---|---|---|
| 5,349,906 | A | 9/1994 | Devaux et al. | |
| 5,377,438 | A * | 1/1995 | Sheinfeld et al. | 42/96 |
| 5,574,245 | A | 11/1996 | Buc et al. | |
| 6,176,032 | B1 * | 1/2001 | Cohen et al. | 42/96 |
| 6,289,623 | B1 | 9/2001 | Cohen et al. | |
| 6,732,628 | B1 * | 5/2004 | Coburn et al. | 273/410 |
| 2007/0017357 | A1 | 1/2007 | Fluhr | |

* cited by examiner

BULLET TRAP

This application is a National Stage Application of PCT/AU2008/000476, filed 3 Apr. 2008, which claims benefit of Ser. No. 2007902058, filed 19 Apr. 2007 in Australia and U.S. Ser. No. 60/944,136, filed on 15 Jun. 2007 and which applications are incorporated herein by reference. To the extent appropriate, a claim of priority is made to each of the above disclosed applications.

RELATED APPLICATIONS

This application is based on and claims the benefit of the filing dates of Australian provisional application 2007902058 filed 19 Apr. 2007, and U.S. provisional application 60/944136 filed 15 Jun. 2007 the contents of which are incorporated herein their entirety.

FIELD OF THE INVENTION

This invention relates to a Bullet Trap and relates particularly but not exclusively to a bullet trap for use with weapons that are used in military or like applications.

BACKGROUND

Hitherto, bullet traps have been known. In some cases, bullet traps are provided for use with rocket launchers in order to capture a bullet that is fired with the rocket launcher and used as a consequence of the detonation to generate gas pressure for the launching of the rocket. Desirably, the bullet is not required to travel with the rocket and is therefore captured. The resulting gas pressure, in turn, launches the rocket and may even detonate the rocket for continued flight. In other applications, such as training of military personnel, it is desired to use blanks so as to prevent death. As a safety precaution, in the event that ball ammunition is loaded in the weapon, a bullet trap is provided. Bullet traps can therefore act as a safety device to capture bullets that may be accidentally discharged. Known bullet traps can cause hazards to the weapon operator, damage to the weapon and have a limited capacity for capturing multiple bullets.

OBJECT AND STATEMENT OF THE INVENTION

There is a need for an alternative bullet trap.

Therefore, according to a first broad aspect of the present invention there is provided A bullet trap comprising a hollow body for connecting to a muzzle end of a weapon that can fire a bullet, the body having a chamber into which a bullet can be fired, said chamber having a io plurality of baffles located one behind the other in an aligned series arrangement and being for absorbing the kinetic energy of a fired bullet to enable the bullet to be trapped and held within the body, each of said baffles having a thickness at the centre of an axis of travel of the bullet less than the thickness at a radially outwardly distant position, whereby to provide for a deformation at the centre of a first of the series of baffles before there will be engagement of a centre of second and subsequent baffles.

In one example said body is a two part body, one part comprising said chamber and the other part comprising a stem that is fittable within a bore end of said weapon, and wherein parts are releasably attached to each other.

In one example the bullet trap comprises a fragment shield positioned in front of said baffles, said fragment shield acting to assist shielding from at least some fragments that may break off a bullet striking one or more of said baffles and otherwise clogging a gas outlet vent to said chamber.

In one example the bullet comprises a gas discharge shield external of the discharge end of a venting aperture through which gas can be discharged, consequent on firing of a bullet or blank, so that the discharge shield will direct discharged gas in a direction corresponding to the direction of firing of the bullet and not rearwardly.

BRIEF DESCRIPTION OF THE DRAWINGS

In order that the invention can be more clearly ascertained, an example for use with a rifle manufactured by Thales Australia will be described with reference to the accompanying drawings. Typically, such rifles/weapons utilise F1 ball ammunition manufactured by Thales Australia.

In the drawings.

Throughout the specification, the term "bullet" is to encompass ball ammunition and other similar ammunition which fires projectiles.

DETAILED DESCRIPTION OF EXAMPLE

Figure 1:
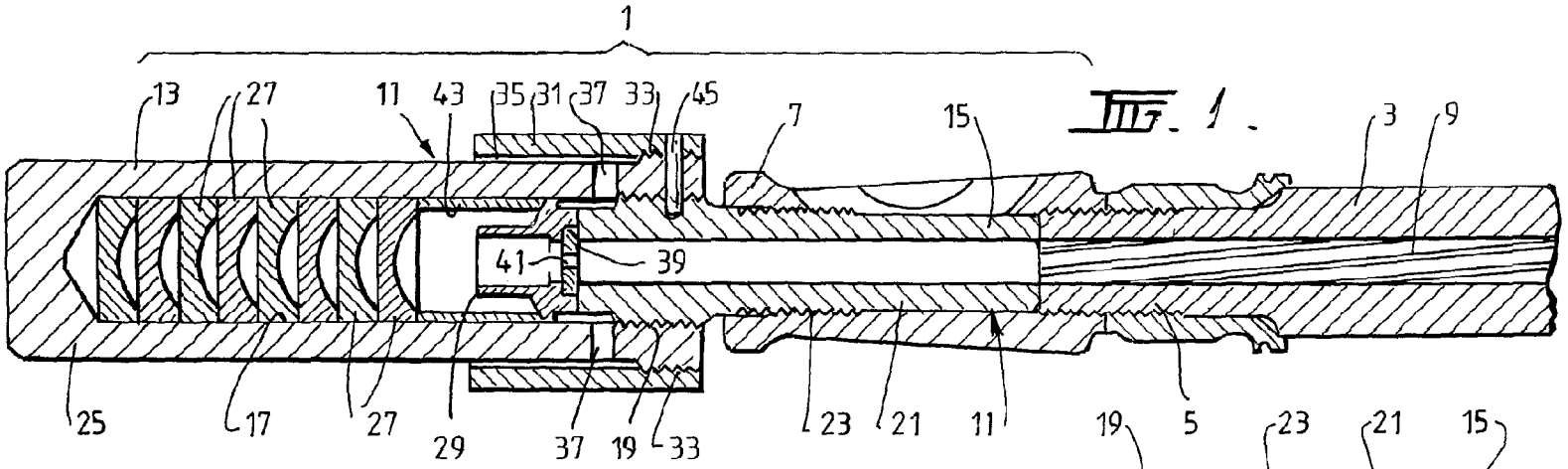
FIG. 1 is a longitudinal vertical cross sectional view taken along the longitudinal central axis of the rifle, and through an example of a bullet trap fitted to the end of the muzzle of the weapon.
Figure 2:
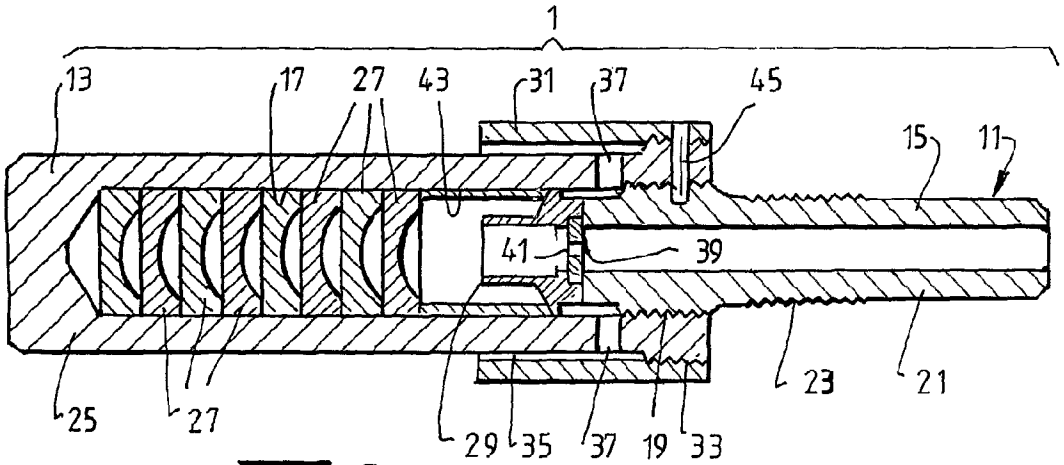
FIG. 2 is a view similar to that shown in FIG. 1 but showing only the bullet trap.

Referring firstly to FIGS. 1 and 2, it can be seen that the example bullet trap 1 is fitted to the end of a weapon such as a rifle 3, at the muzzle end 5. The weapon typically contains a muzzle 7 that is screw threadably fastened to the muzzle end 5 of the weapon 3. The weapon 3 has a central longitudinally extending bore 9 that may be riffled in a conventional manner. The longitudinal central axis of the bore 9 coincides with a central longitudinal axis of the bullet trap 1. Typically, the bullet trap 1 is of circular transverse cross section, however, other transverse cross sectional shapes are not excluded. The bullet trap 1 has a body 11 comprised of one part 13 and another part 15. The one part 13 has a chamber 17 therein into which a bullet can be fired from the weapon 3. The one part 13 and the other part 15 are releasably screw threadably attached to each other by screw threads 19. The chamber 17 is elongate and is aligned along the central longitudinal axis of the bore 9. The another part 15 comprises a stem 21 that can be received with the hollow interior of the muzzle 7 of the weapon 3 and screw threadably fastened therein by screw thread 23. The chamber 17 is closed at its distal end 25, and the chamber 17 has a plurality of baffles 27 located therein one behind the other in an aligned series arrangement and being for absorbing the kinetic energy of a fired bullet. The baffles 27 enable the bullet to be trapped and held within the body 11 in the chamber 17.

The bullet trap 1 also comprises a fragment shield 29 that is positioned in front of the baffles 27 (relative to a direction of firing of a bullet) and acts to assist shielding from at least some fragments that may break off a bullet striking one or more of the baffles 27 and otherwise returning in an opposite direction to the direction of firing and into gas outlet vents (to be described hereinafter).

The bullet trap 1 also comprises a gas discharge shield 31 which is used to direct any gas discharged from the firing of the weapon in direction corresponding to the direction of firing of the bullet, and not rearwardly towards the person operating the weapon 3. The gas discharge shield 31 is releasably fastened to the body 11 by screw threadably fastening to the one part 13 by screw thread 33. The gas discharge shield 31 therefore provides a narrow forwardly directing annular passageway 35 between its internal cylindrical surfaces and the external cylindrical surfaces of the one part 13. FIGS. 1 and 2 both clearly show that the annular passageway 35 is open at the end thereof corresponding to the direction of firing of the bullet and not in a rearward direction towards the person operating the weapon 3. The gas discharge shield 31 overlays at least one vent 37 that is formed from a vent aperture that defines a passageway that extends radially outwardly from the chamber 17 and at the end of the chamber adjacent the other part 15. Thus, gas that generates consequent on the firing of the weapon 3 will pass along the bore 9 through the hollow interior of stem 21, through the hollow interior of fragment shield 29 and into chamber 17. The gas will then build up in pressure and pass through passageways (to be described hereinafter) so that the gas can then pass through vent 37 and into annular passageway 35 to discharge to atmosphere.

A tell tale shot detector 39 is positioned between and against the fragment shield 29 and the end of the other part 15 that is attached to the one part 13. The tell take shot detector 39 can be used to permit a person to visually determine if the bullet trap 1 has been used for trapping a bullet by noting a visible change of the integrity of the tell tale shot detector 39. Thus, a person can release the one part 13 from another part 15 and visibly inspect the tell tale shot detector 39 for any visible disconformity and change in integrity that would be caused on the passage of the bullet 5 from the weapon 3. Alternatively a go/no go gauge may be used. If blank ammunition is used then a gauge consisting of a rod of diameter larger than the tell tale shot detector bore is inserted into the bullet trap and it will stop at a specific length when it engages the tell tale shot detector. On the other hand if a bullet has passed through the tell tale shot detector then the same gauge will sink further into bullet trap thus signalling that a bullet was fired. The tell tale shot detector 39 has a central aperture 41 to allow gases which may generate on firing of a blank shot to pass into the chamber 13 and then out through at least one vent 37 and the annular passageway 35.

A compression sleeve 43 is located within the chamber 17 between and against a first baffle 27 and the fragment shield 29. The compression sleeve 43 is of a suitable length so that when the one part 13 and the another part 15 are attached to one another, the compression sleeve 43 will be axially longitudinally compressed and cause the baffles 27 to matingly engage with each other at the distal end 25 of the chamber 17 and to cause the fragment shield 29 to be urged in the direction towards the other part 15. The compression sleeve also suitably spaces the fragment shield 39 relative to the first baffle 27.

A lock in the form of a locking pin 45, or any other suitable lock, may be utilised to lock the gas discharge shield 31, said one part 13, and said other part 15 from releasable attachment to each other until the lock is released. In this case, the locking pin 45 passes through suitable apertures in the gas discharge shield 31, the one part 13, and the another part 15 where they are screw threadably attached to each other. Unlocking occurs by radially outwardly moving the locking pin 45 to a position where it is removed from those apertures. The gas discharge shield 31 can then be unscrewed from the one part 13, and the one part 13 can then be unscrewed from the other part 15.

Figure 3:
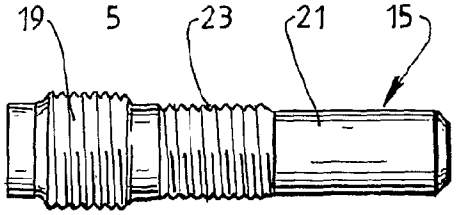
FIG. 3 is a side elevational view of a stem of the bullet trap.
Figure 4:
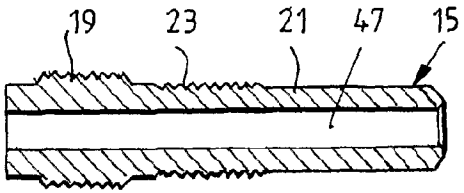
FIG. 4 is a vertical cross section of the stem taken along a longitudinal central axis thereof.

Referring now to FIGS. 3 and 4 it can be seen that the another part 15 has a stem 21 for fitting within the muzzle 7. A screw thread 23 is provided on the external surface of the stem 21 for releasable attachment. The another part 15 has a central bore 47 through which the bullet can pass. The bore 47 is of a suitable diameter and axially aligned with the bore 9 of the weapon 3. The another part 15 also has a further screw thread 19 to facilitate the attachment of the one part 13.

Figure 5:
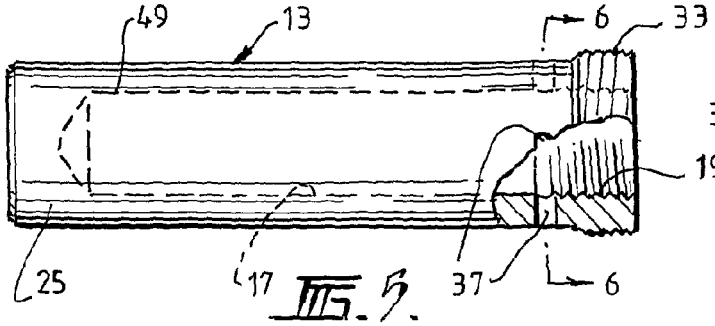
FIG. 5 is a side elevational view of a chamber of the bullet trap.
Figure 6:
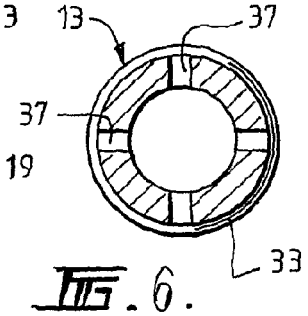
FIG. 6 is a transverse cross sectional view of the chamber taken along section lines 6-6 of FIG. 5.

Referring now to FIGS. 5 and 6, it can be seen that the one part 13 has an elongate body 49 that surrounds chamber 17. The distal end 25 of the one part 13 is closed. A screw thread 19 is provided on the internal surfaces of the open end of the chamber 17 to facilitate attachment relative to another part 15. The open end of the another part 13 has an external screw thread 33 to permit releasable attachment of the gas discharge shield 31. At least one vent 37 is provided in a passageway that extends in a direction radially outwardly and perpendicularly to the longitudinal central axis of the bore 9 of the weapon 3. In this case, four vents 37 are shown equally angularly spaced. Other numbers of vents may be provided. The vents need not extend perpendicular to the longitudinal central axis but may be inclined or otherwise configured relative to the central longitudinal axis of the bore 9.

Figure 9:
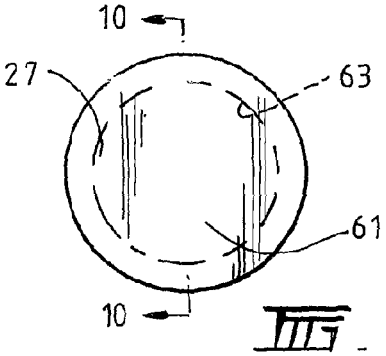
FIG. 9 is an end view of a baffle taken from the left hand end of FIG. 2.
Figure 7:
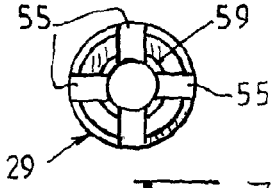
FIG. 7 is an end view of a fragment shield taken from the right hand end when referring to FIG. 2.
Figure 8:
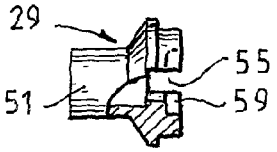
FIG. 8 is a side elevational view of the fragment shield.
Figure 10:
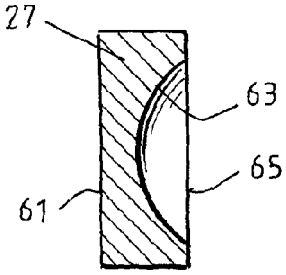
FIG. 10 is a vertical cross sectional view taken along section line 10-10 of FIG. 9.

FIGS. 7 and 8 show the fragment shield 29 having an outer shield surface 51 that has a part that extends longitudinally and parallel to the bore 9 and another part where there is an inclined outwardly directed shielding part 53. The external diameter of the outwardly directed shielding part 53 corresponds to the internal diameter of the chamber 17. The end of the shield that abuts with the another part 15 is provided with four radially outwardly extending passageways 55. Whilst four passageways 55 have been shown other numbers such as one passageway, or many multiple passageways, may be provided. FIG. 8 shows the passageways 55 in side elevation. FIG. 8 also shows that the part of the gas discharge shield 31 that abuts with the another part 15 has a slightly smaller diameter than the outermost diameter of the outwardly directed shielding part 53. This is identified by numeral 57. Thus, in use, gas consequent on discharge of the weapon can travel along the bore 9 and to into the chamber 17. Pressure will build up, and as a consequence, the gas will pass through the one or more passageways 53 into a space between the outer circumferential diameter indicated by numeral 57 and the internal diameter of the chamber 17. The gas can then pass into the vents 37 and out through the annular passageway 35. FIG. 8 also shows a circular recess 59 extending part way into the opening 41 of the gas discharge shield 31. The recess 59 is of a suitable diameter to receive the tell tale shot detector 39. It is also noted from observing FIG. 8 that when the tell tale shot detector 39 is fully seated within the circular recess 59, it will not completely obstruct the passageway 55. Thus, gas will be able to pass along passageway 55 to be discharged from the weapon 3. The fragment shield 29 therefore acts to inhibit spawl from a bullet that may break off the bullet on impact with baffles 27 from entering the vent 37 and clogging the vent FIGS. 9 and 10 show the construction of each of the baffles 27. Here each baffle is of disc like shape that has a planar rearward face 61, and a concave dome shaped recess 63 on a forward face 65. The effect of the concave recess 63 is to provide the baffle 27 with a thickness at the centre of an axis of travel of the bullet which is less than the thickness at a radially outwardly distant position, such as at the outermost circumferential surface of the baffle 27. This provides for deformation of the baffle 27 at the centre of a first of a series of the baffles 27 before there will be engagement of a centre of a second and subsequent baffles 27. In other words, when a bullet strikes the centre of a first baffle 27 it will cause a deformation of the baffle 27 before the centre of the deformed baffle 27 will impinge on the centre of the next adjacent baffle 27. This provides a controlled absorption of kinetic energy of a fired bullet into the bullet trap 1. If the baffles 27 were each completely disc like with a planar rearward face 61 and a planar forward face of recess 63 then a bullet striking the first baffle 27 would be in direct mating engagement with the next baffle and so on and thus there would be a tight compaction of the baffles without any space being provided for deformation of the baffles in a progressive manner. The arrangement of providing the plurality of baffles 27 located one behind the other in an aligned series arrangement has been found to be beneficial for absorbing the kinetic energy of the fired bullet such that multiple bullets can be fired into the bullet trap without the bullet trap 1 experiencing significant outer surface deformation or degradation. Thus, whilst in some prior art bullet traps, baffles of the disc like type with planar rear faces and forward faces have been used, such baffles have not acted to absorb the kinetic energy in such an efficient way as with the current embodiment.

Figure 11:
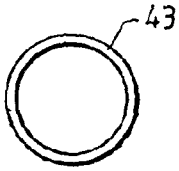
FIG. 11 is an end view of a compression sleeve.
Figure 12:
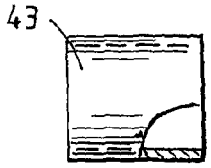
FIG. 12 is a side elevational view of the compression sleeve.

Referring now to FIGS. 11 and 12 which show the compression sleeve 43 it can be seen that the compression sleeve 43 is a thin walled sleeve of a required length to effect the compression and compacting of the baffles 27 against one another, and the required positioning of the fragment shield 29.

Figure 13:
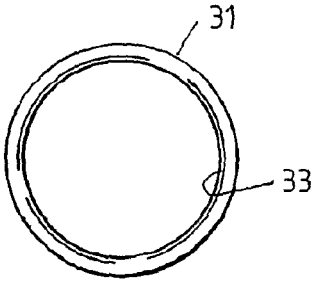
FIG. 13 is an end view of a gas discharge shield.
Figure 14:
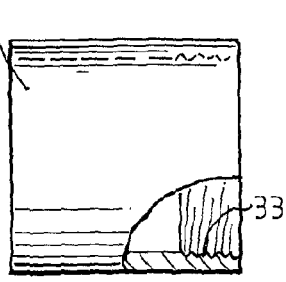
FIG. 14 is a side elevational view of the gas discharge shield.

Referring now to FIG. 13 which shows the gas discharge shield 31, it can be seen that it is of a thin wall cylindrical shape with an internal screw thread 33 for permitting releasable attachment to the external surface of the one part 13.

Figure 15:
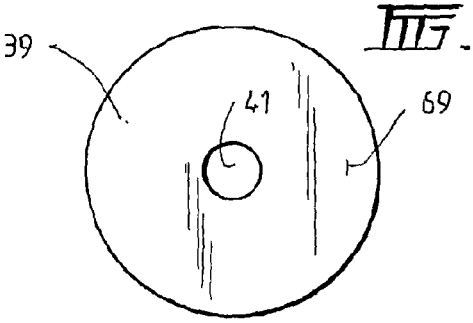
FIG. 15 is an end view of a tell tale shot detector.
Figure 16:
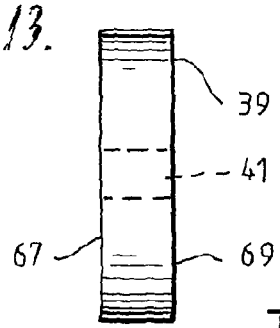
FIG. 16 is a side elevational view of the tell tale shot detector.

Referring now to FIGS. 15 and 16, it can be seen that the tell tale shot detector 39 is of disc like appearance with a planar rear face 67 and planar front face 69. An aperture 41 is provided at the central axis of the circular tell tale shot detector 39 to allow the passage of gas therethrough. The diameter of the aperture 41 is smaller than the diameter of the bullet. Thus, if a bullet should strike the tell tale detector 39, it will pass therethrough and cause a visible change to the integrity of the tell tale shot detector 39 which can be visibly determined. This therefore allows a person to disassemble the bullet trap 1 and determine readily if it has been previously used to trap bullets. If genuine blank ammunition has been fired, then the tell tale detector 39 will be visibly of the original integrity. Thus, it can be visibly determined that the bullet trap 1 can be safely reused.

Typically, for use with an Austeyr A1/A2rifle manufactured by Thales Australia, the first part 13 will have an overall length of approximately 88 mm. The chamber 17 will have a length of approximately 77 mm. The diameter of the chamber 17 will be approximately 15 mm and the outer diameter of the one part 13 that extends parallel with the bore of the chamber will have a diameter of 24 mm. The overall length of the another part 15 will typically be 61 mm. The baffles 27 typically have a diameter of 14.9 mm and a thickness of approximately 5 mm. The radius of the domed recess will be typically 8 mm, and the open face of the dome has a maximum diameter of 11.9 mm. The thickness of the material at the centre of the longitudinal axis will be 2.3 mm. The length of the fragment shield 29 will be typically 13 mm with the external diameter being approximately 14.9 mm. The gas discharge shield 31 typically has an external diameter of 31 mm and an internal diameter of 26 mm. The external surface may be suitably knurled. The compression sleeve 33 can have an external diameter of 14.9 mm with an internal diameter of 12.9 mm, and a length of 16 mm. The tell tale shock detector 39 may have a diameter of 8 mm and a thickness of 2 mm. The central aperture may be 1.3 mm in diameter.

The one part 13, the another part 15, the gas discharge shield 31, the fragment shield 29, and the tell tale shot detector 39 may all be manufactured from steel and finished with a manganese phosphate coating The baffles 27 may be manufactured from steel to AS1443/1045 or 4040 quality and manganese phosphate coated.

Tests with an example of the bullet trap described above show that up to eight bullets can be captured without there being significant change to the external surface of the bullet trap.

It should be appreciated that because the baffles 27 have a generally spherical concave impression, a bullet is guided towards the centre of mass. This assists in reducing the transfer of energy from one baffle to the next as the bullet moves forwardly through the baffles into the bullet trap device. The gap between adjacent baffles therefore facilitates the transfer/absorption of kinetic energy from the bullet in a progressive manner and does not act like a collective solid mass of baffles 27. Once a baffle 27 is penetrated by a bullet, the back edges of the baffle 27, being the edges facing the direction of the receipt of the bullet, act as catching edges and reduce any spawling from the bullet travelling into the gas vents.

Modifications may be made to the example described above without departing from the ambit of the invention. For example, instead of fastening the one part 13 and another part 15 and discharge shield 31 to each other by screw threaded fastening means, other fastening means may be utilised. One of these alternative fastening means may include bayonet type rotating fastening means. Similarly, the bullet trap 1 may be fitted to the end of the weapon 3 by any suitable convenient fastening attachment means and need not be screw threaded as shown in the example. For example other fastening means such as bayonet type screw fastening means may be utilised. Whilst eight baffles 27 have been shown, other numbers of baffles 27 may be included and the appropriate length readjusted to accommodate the number of baffles 27 utilised.

It is to be understood that, if any prior art publication is referred to herein, such reference does not constitute an admission that the publication forms a part of the common general knowledge in the art, in Australia or any other country.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

These and other modifications may be made without departing from the ambit of the invention the nature of which is to be determined from the foregoing description.

The invention claimed is:

1. A bullet trap comprising a hollow body for connecting to a muzzle end of a weapon that can fire a bullet, the body remaining releasable connected to the muzzle end during and after firing, and the body having a chamber into which a bullet can be fired, said chamber having a plurality of baffles located one behind the other in an aligned series arrangement to enable the bullet to be trapped and held within the body, each of said baffles having a concave recess on a forward face so that a thickness of the baffle at a center of an axis of travel of the bullet is less than the thickness at a radially outwardly position, wherein the plurality of baffles are arranged and configured to absorb kinetic energy of the bullet when the bullet strikes the center of a first baffle of the series of baffles, and wherein the first baffle is deformed by the bullet before engagement with a center of a second baffle of the series of baffles, the bullet trap further comprising a fragment shield positioned in front of said baffles, and a gas outlet vent to said chamber, wherein said fragment shields the gas outlet vent from at least some fragments that may break off a bullet striking one or more of said baffles.

2. A bullet trap as claimed in claim 1, wherein said body is a two part body, one part comprising said chamber and the other part comprising a stem that is fittable within a bore end of said weapon, and wherein both parts are releasably attached to each other.

3. A bullet trap as claimed in claim 2, wherein said one part and said other part are screw thread releasably attached to each other.

4. A bullet trap as claimed in claim 2, comprising a fragment shield positioned in said chamber between said other part and said baffles, at a position nearer said other part than said baffles.

5. A bullet trap as claimed in claim 2, wherein said chamber comprises at least one vent for permitting a gas discharge from said chamber to atmosphere, said gas being generated as a consequence of firing of said bullet into said chamber.

6. A bullet trap as claimed in claim 5, wherein said at least one vent comprises at least one aperture that has a passageway extending radially outwardly from said chamber.

7. A bullet trap as claimed in claim 2, wherein said chamber comprises at least one vent aperture that has a passageway extending radially outwardly from said chamber, said at least one vent being at the end of said chamber adjacent said other part.

8. A bullet trap as claimed in claim 7, comprising a gas discharge shield external of a discharge end of said at least one vent aperture, said gas discharge shield acting, in use, to direct discharge gas passing through said at least one vent aperture in a direction of firing of said bullet.

9. A bullet trap as claimed in claim 8, wherein said gas discharge shield is releasably attached to said one part at a position adjacent where said one part and said other part are releasably attached to each other.

10. A bullet trap as claimed in claim 9 comprising a lock for locking said gas discharge shield, said one part and said other part, from releasable attachment, whereby said shield, said one part, and said other part cannot be releasably detached from one another without the lock being moved to an unlocking position.

11. A bullet trap as claimed in claim 9, comprising a fragment shield positioned in front of said baffles, said fragment shield acting to assist shielding from at least some fragments that may break off a projectile striking one or more of said baffles and otherwise clogging a vent of said chamber, said bullet trap also comprising a tell tale shot detector positioned between said fragment shield and end of said other part that is releasably attachable to said one part, whereby when the one part and the other part are detached from one another the tell tale shot detector will permit a person to visibly determine if the bullet trap has been used for trapping a bullet by noting a visible change to the integrity of the tell tale shot detector.

12. A bullet trap as claimed in claim 4, comprising a compression sleeve for locating within said chamber between and against a first baffle and said fragment shield, said compression sleeve being of a suitable length so that when said one part and said other part are attached to one another, said compression sleeve will be axially longitudinally compressed, and cause said baffles to matingly engage with each other at a distal end of said chamber and to cause said fragment shield to be urged in a direction towards said other part.

13. A bullet trap as claimed in claim 12, comprising a tell tale shot detector positioned between and against said fragment shield and the end of said other part that is releasably attached to said one part, and wherein said tell tale shot detector is located within a recess in said fragment shield.

* * * * *